US005078375A

United States Patent [19]

Steidinger

[11] Patent Number: 5,078,375

[45] Date of Patent: Jan. 7, 1992

[54] METHOD OF SUPERPOSING WEBS

[75] Inventor: Donald J. Steidinger, Barrington, Ill.

[73] Assignee: Tamarack Products, Inc., Barrington, Ill.

[21] Appl. No.: 622,953

[22] Filed: Dec. 6, 1990

[51] Int. Cl.[5] ..... B65H 39/00

[52] U.S. Cl. ..... 270/52; 270/60

[58] Field of Search ..... 270/21.1, 52, 52.5, 270/60; 83/93, 924, 935, 331

[56] References Cited

U.S. PATENT DOCUMENTS

| | | | |
|---|---|---|---|
| 3,070,365 | 12/1962 | Lohrmann | 270/52 |
| 3,104,799 | 9/1963 | Steidinger . | |
| 3,339,827 | 9/1967 | Steidinger . | |
| 3,363,520 | 1/1968 | Obenshain | 270/60 |
| 3,777,971 | 12/1973 | Steidinger . | |
| 4,014,535 | 3/1977 | Kleid | 270/21.1 |
| 4,095,695 | 6/1978 | Steidinger . | |
| 4,190,241 | 2/1980 | Kruger | 270/60 |
| 4,231,558 | 11/1980 | Aterianus | 270/60 |
| 4,349,185 | 9/1982 | Steidinger . | |

FOREIGN PATENT DOCUMENTS

| | | | |
|---|---|---|---|
| 2383872 | 10/1978 | France | 270/52 |
| 12567 | 1/1988 | Japan | 270/52 |

*Primary Examiner*—Edward K. Look
*Assistant Examiner*—Therese M. Newholm
*Attorney, Agent, or Firm*—Tilton, Fallon, Lungmus & Chestnut

[57] ABSTRACT

A method for superimposing webs where multiple ply cut pieces are applied to a carrier from one vacuum applicator cylinder or drum by first cutting multiple pieces from continuous webs and aligning the trailing edge of the multiple pieces or web lengths. These pieces may be of equal or unequal lenghth or of equal or unequal width and these are applied to a carrier at high speed and accurately positioned irrespective of whether the carrier is continuous or non-continuous. The invention applies to lengths of paper, film, foil, fabric or the like, any of which that are flexible enough to conform to the vacuum drum or cylinder by vacuum.

11 Claims, 1 Drawing Sheet

METHOD OF SUPERPOSING WEBS

BACKGROUND AND SUMMARY OF INVENTION

This invention relates to a method of superposing webs and more particularly, to web lengths which are developed from two continuous webs by transversely severing the same on a vacuum drum.

Vacuum drums have been long used for transporting cut web lengths, viz., paper sheets, in connection with paper napkins, tissues, etc. And in some case there has been superposition of webs on a vacuum drum, see for example, U.S. Pat. No. 4,349,185.

However, such usages have not been widely employed, particularly in the business forms industry. For example, even though web lengths are superposed in "mailers"—see my earlier U.S. Pat. Nos. 3,104,799; 3,339,827; 3,777,791 and 4,095,695, there has not been resort to vacuum drums carrying superposed web lengths.

According to the invention, I apply multiple ply cut pieces to a carrier from one vacuum applicator cylinder or drum by first cutting multiple pieces from continuous webs and aligning the trailing edge of the multiple pieces or web lengths. These pieces may be of equal or unequal length or of equal or unequal width and these are applied to carrier means at high speed and accurately positioned thereon, irrespective of whether the carrier is continuous or non-continuous. The invention applies to lengths of paper, film, foil, fabric or the like—any of which that are flexible enough to conform to the vacuum drum or cylinder by vacuum.

BRIEF DESCRIPTION OF DRAWING

The invention is described in conjunction with the accompanying drawing, in which—

DETAILED DESCRIPTION

Figure 2:
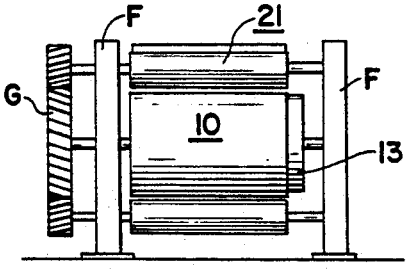
FIG. 2 is an end elevational view, partially schematic, of the apparatus of FIG. 1.

The vacuum applicator consists of a vacuum drum 10 rotatably supported by frames F—see FIG. 2—which provides a longitudinally-extending path therebetween for web lengths. The vacuum drum 10 has a plurality of vacuum holes 11 spaced advantageously on the surface of the drum. The vacuum holes 11 are connected to channel 12 that provide the flow of air used to create a vacuum. The flow of air is turned on and off by manifold 13 shown only at one end of drum 10. The manifold has ports 14 that permit the flow of air from vacuum holes 11 during a portion of the rotation of drum 10. Thus, there is a portion of each revolution of drum 120 when the air is allowed to flow creating a vacuum at holes 11 during which time the drum tends to feed the material to be cut up to the position 16 at which it is cut from the continuous webs of material 15 and 15*a*. Until the cut takes place, the feed of the webs of material 15 and 15*a* is controlled by feed rolls, pin feeds, optical registration means or the like (as explained later) to a speed which is usually slower than the surface rotating drum 10 or at the most, a speed equal to the surface speed of drum 10.

Figure 1:
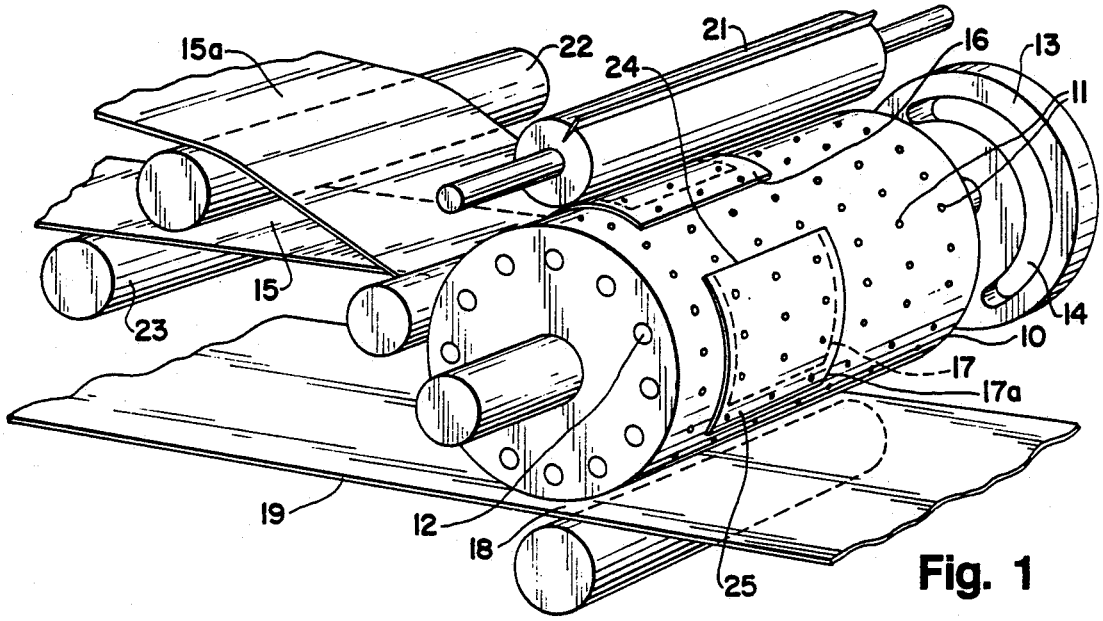
FIG. 1 is a fragmentary perspective view of apparatus for practicing the invention.
Figure 3:
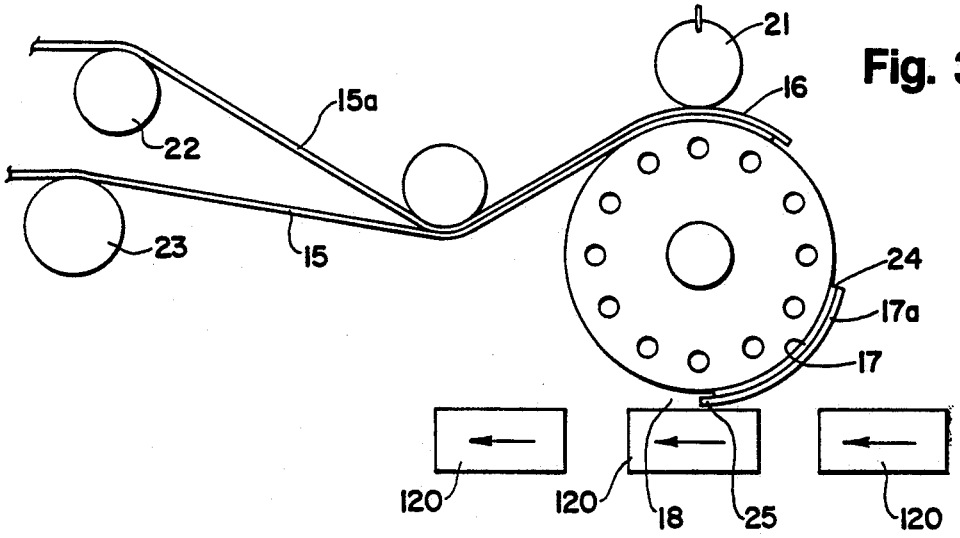
FIG. 3 is a side elevational view of the showing in FIG. 1 but featuring a different receiving carrier.

After the material webs 15 and 15*a* are cut at position 16, the cut pieces 17 and 17*a* become attached to the surface of drum 10 by the vacuum in holes 11 and move at the surface speed of drum 10 to the position 18 when they are to be applied to the carrier web 19 (FIG. 1) or individual items 120 (FIG. 3). At position 18, the vacuum is stopped by the manifold 13 and the cut pieces are released from the applicator drum 10. It is advantageous to move the carrier web 19 or item 120 past the drum 10 at the surface speed of drum 10 or close to this speed for best accuracy of placement of the cut pieces 17 and 17*a* on the carrier web 19 or item 120.

Infeed For the Multiple Webs Before Cut-Off

A first web 15 is fed a specified length for each revolution of the cutoff cylinder 21 using feed rolls 22 and 23 or the like. The cylinder 21 and vacuum drum are advantageously driven by gearing G—see FIG. 2. The first web 15 is in a position directly in contact with vacuum cylinder 10. Web 15*a* is also fed a specified length, usually longer or shorter than the length of the first web but it could be equal to the specified length of the first web 15—by adjusting the relative speeds of advance of the two webs.

When web 15*a* is wider than web 15, the additional width extending on one or both sides of web 15 is exposed to vacuum holes 11 that urge it in the direction of rotation of vacuum drum 10. The feed length of web 15*a* for each cutoff can be more, less, or equal to the feed length of web 15*a*.

When web 15*a* is narrower than web 15, it is necessary to provide other means of urging web 15*a* in the direction of vacuum drum 10. Web 15 may be porous enough for the vacuum to grip web 15*a* sufficiently, or static electricity may be developed by friction between the two webs, or a static charge may be introduced on one of the webs. The two webs can also be held by a line or pattern of glue between the webs. In any event, the two webs are held together sufficiently so both are carried by the vacuum drum. In these cases, the specified length of web 15*a* can be less than or equal to the length of web 15.

When the webs 15 and 15*a* are moving at a speed slower than the surface speed of drum 10, there is a sliding of the webs on drum 10 as the vacuum feeds the webs only as fast as the feed rolls 22 and 23 allow. It is evident that more than two webs may be fed and cut off in a similar way.

Feeding of the Pieces After Cutoff

When the cutoff takes place at position 16 by the cutoff cylinder 21, all of the webs are cut simultaneously and the tailing edges of the cut pieces 17 and 17*a* are in alignment as at 24. The differences in length, if any, are on the leading edge. Once the pieces 17 and 17*a* are cut off, they remain in the same relative position to each other and are carried by the vacuum drum at the surface speed of drum 10 to the place of transfer 18 to the carrier.

When piece 17*a* is longer than the piece 17, there will be a portion 25 at the leading edge that is exposed to the vacuum holes 11. This leading edge is an advantageous area to be held by vacuum as the leading edge is most exposed to disturbance by air resistance. The trailing ends 24 are naturally inclined to follow around without problems as cylinder 10 rotates.

When cut piece 17 is equal or shorter in length than cut piece 17*a*, other means are required to hold the pieces in fixed relationship. Some of the other means available are that piece 17 is wider than piece 17*a* on one or both sides thus providing an area exposed to vacuum holes 11, that piece 17 is porous enough for the vacuum to grip piece 17 through piece 17*a*, that a static change either naturally generated by friction or electrically generated and induced holds the pieces together or that glue or other fastening means hold the pieces in fixed relation to each other after cutoff.

It can be seen that by this means, several pieces of material can be cut to various lengths from a web, held in the position established at the time of cutoff with all trailing edges aligned and transported to the place of transfer to a carrier.

While in the foregoing specification a detailed description of an embodiment of the invention has been set down for the purpose of illustration, many variations in the details hereingiven may be made by those skilled in the art without departing from the spirit and scope of the invention.

I claim:

1. A method of superposing web lengths comprising advancing a pair of webs along a longitudinally extending path toward a rotating cut-off/vacuum drum, and superposing said webs thereon, simultaneously cutting through both webs to provide transversely aligned trailing edges in both web lengths, transporting both cut webs on said drum under the influence of vacuum for a portion of one rotation thereof, and after said rotation portion stopping the influence of said vacuum and depositing said superposed webs on a carrier, the web length adjacent the drum having a smaller area than the web length superposed on said adjacent web length.

2. The method of claim 1 in which said adjacent web length is longitudinally smaller than said superposed web length.

3. The method of claim 1 in which said webs are applied to a further web and combined therewith to provide a mailer.

4. A method of superposing web lengths comprising advancing a pair of webs along a longitudinally extending path toward a rotating cut-off/vacuum drum, and superposing said webs thereon, simultaneously cutting through both webs to provide transversely aligned trailing edges in both web lengths, transporting both cut webs on said drum under the influence of vacuum for a portion of one rotation thereof, and after said rotation portion stopping the influence of said vacuum and depositing said superposed webs on a carrier, said webs being advanced at different speeds.

5. The method of claim 4 in which said webs are applied to a further web and combined therewith to provide a mailer.

6. A method of superposing web lengths comprising advancing a pair of webs along a longitudinally extending path toward a rotating cut-off/vacuum drum, and superposing said webs thereon, simultaneously cutting through both webs to provide transversely aligned trailing edges in both web lengths, transporting both cut webs on said drum under the influence of vacuum for a portion of one rotation thereof, and after said rotation portion stopping the influence of said vacuum and depositing said superposed webs on a carrier, the web length adjacent the drum having a smaller area than the web length superposed on said adjacent web length, said adjacent web length being transversely smaller than said superposed web length.

7. A method of superposing web lengths comprising advancing a pair of webs along a longitudinally extending path toward a rotating cut-off/vacuum drum, and superposing said webs thereon, simultaneously cutting through both webs to provide transversely aligned trailing edges in both web lengths, transporting both cut webs on said drum under the influence of vacuum and depositing said superposed webs on a carrier, the web length adjacent the drum having a larger area than the web length superposed on said adjacent web length.

8. The method of claim 7 in which the said adjacent web length has a porosity sufficient to cause said superposed web length to be maintained in superposed position by vacuum from said drum.

9. The method of claim 7 in which a static electric charge is applied to at least one of said webs to maintain the same in superposed relationship.

10. The method of claim 7 in which said webs develop static electricity incident to superposition sufficient to maintain the same in superposed relationship.

11. The method of claim 7 in which said webs are applied to a further web and combined therewith to provide a mailer.

* * * * *